US008864275B2

(12) United States Patent
Batchelor et al.

(10) Patent No.: US 8,864,275 B2
(45) Date of Patent: Oct. 21, 2014

(54) SYSTEM FOR DETECTING LEAKAGE OF PHASE CHANGE INKS

(75) Inventors: Glenn D. Batchelor, Fairport, NY (US); Chad E. LaBarge, Poplar Grove, IL (US); Ali R. Dergham, Fairport, NY (US); Randall E. Kaufman, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 93 days.

(21) Appl. No.: 13/325,415

(22) Filed: Dec. 14, 2011

(65) Prior Publication Data

US 2013/0155138 A1 Jun. 20, 2013

(51) Int. Cl.
*B41J 29/38* (2006.01)

(52) U.S. Cl.
USPC ..... 347/17; 347/5; 347/19; 347/88; 347/99; 347/103

(58) Field of Classification Search
USPC ..... 347/5–7, 17, 88, 99, 103
See application file for complete search history.

(56) References Cited

U.S. PATENT DOCUMENTS

| | | | | |
|---|---|---|---|---|
| 4,007,684 | A | 2/1977 | Takano et al. | |
| 4,961,081 | A | 10/1990 | Shiga | |
| 5,422,276 | A | 6/1995 | Colvin | |
| 6,227,642 | B1 | 5/2001 | Hanabusa et al. | |
| 6,402,277 | B1 * | 6/2002 | Monclus et al. | 347/7 |
| 6,406,118 | B1 | 6/2002 | Aoki et al. | |
| 6,431,678 | B2 * | 8/2002 | Beck et al. | 347/19 |
| 6,565,172 | B2 | 5/2003 | Huang et al. | |
| 6,679,576 | B2 * | 1/2004 | Crivelli | 347/17 |
| 6,798,800 | B2 * | 9/2004 | Sprock et al. | 372/34 |
| 6,984,029 | B2 | 1/2006 | Bellinger et al. | |
| 7,182,423 | B2 | 2/2007 | Su et al. | |
| 7,290,872 | B2 * | 11/2007 | Calamita et al. | 347/88 |
| 7,458,669 | B2 * | 12/2008 | Jones et al. | 347/88 |
| 7,588,307 | B2 * | 9/2009 | Hong et al. | 347/17 |
| 7,789,474 | B2 | 9/2010 | Seki et al. | |
| 2005/0001869 | A1 * | 1/2005 | Abernathy et al. | 347/17 |
| 2010/0192685 | A1 * | 8/2010 | Sabanovic et al. | 73/290 R |
| 2011/0221802 | A1 * | 9/2011 | Sabanovic et al. | 347/7 |

* cited by examiner

*Primary Examiner* — Manish S Shah
*Assistant Examiner* — Jeremy Delozier
(74) *Attorney, Agent, or Firm* — Maginot Moore & Beck LLP

(57) ABSTRACT

A printing apparatus includes a printhead module having an ink leakage detector to detect a leaked phase change ink. The ink leakage detector includes a plurality of resistance temperature detectors or resistive thermal devices to detect the leaked phase change ink. A horizontally mounted overdriven thermistor can also be used to detect leaked ink.

16 Claims, 8 Drawing Sheets

218
220
220
234
236
250
250
250
252
250
230
232
240
238
239
250
242
250
250
250

SYSTEM FOR DETECTING LEAKAGE OF PHASE CHANGE INKS

TECHNICAL FIELD

This disclosure relates generally to an inkjet printer having one or more printheads, and more particularly, to the detection of ink leakage in a phase change inkjet printer.

BACKGROUND

Inkjet printers have printheads that operate a plurality of inkjets that eject liquid ink onto an image receiving member. The ink can be stored in reservoirs located within cartridges installed in the printer. Such ink can be aqueous ink or an ink emulsion. Other inkjet printers receive ink in a solid form and then melt the solid ink to generate liquid ink for ejection onto the image receiving member. In these solid ink printers, the solid ink can be provided in the form of pellets, ink sticks, granules, pastilles, or other shapes. The solid ink is typically placed in an ink loader and delivered through a feed chute or channel to a melting device that melts the ink. The melted ink is then collected in a reservoir and supplied to one or more printheads through a conduit or the like. In other inkjet printers, ink can be supplied in a gel form. The gel is also heated to a predetermined temperature to alter the viscosity of the ink so the ink is suitable for ejection by a printhead.

A typical inkjet printer uses one or more printheads. Each printhead typically contains an array of individual nozzles for ejecting drops of ink across an open gap to an image receiving member to form an image. The image receiving member can be a continuous web of recording media, a series of media sheets, or the image receiving member can be a rotating surface, such as a print drum or endless belt. Images printed on a rotating surface are later transferred to recording media by mechanical force in a transfix nip formed by the rotating surface and a transfix roller.

An external reservoir supplies ink to a manifold which dispenses heated ink through heated conduits to the printheads. The heated ink conduits, typically hoses or tubes, carry heated ink from the reservoir through the manifold to the printheads. When ink is being supplied to the printheads from the manifold, liquid ink can leak from the heated conduits either through a fault at the conduit or at points of connection where the conduit is coupled to system components, including the reservoir, the manifold, the printheads, and other locations. Should liquid ink leak into the inkjet printer and its components, a repair of the system may be required to correct the cause of the leak and to clean the area in which the ink leaked. Avoiding these repairs and the printer downtime associated with them would be beneficial.

SUMMARY

A printing apparatus includes a leak detector to detect an ink leak in a printhead module having printheads that receive heated phase change ink from conduits coupled to a manifold. The printing apparatus includes a printhead having an inlet for receiving heated phase change ink from a source of ink and a heated conduit having a first end and a second end. The first end of the heated conduit is operatively connected to the inlet of the printhead and the second end is operatively connected to the source of ink to carry the heated phase change ink from the source of ink to the printhead. The printhead is mounted to a housing through which at least a portion of the heated conduit passes. The printing apparatus includes a temperature sensing device configured to sense a change in temperature in response to a leaked heated phase change ink contacting the temperature sensing device. The temperature sensing device is positioned at a location in the housing where gravity can direct the leaked heated phase change ink into contact with the temperature sensing device. An annunciator is operatively connected to the temperature sensing device and is configured to activate in response to the leaked heated phase change ink contacting the temperature sensing device.

In another embodiment, a printhead module deposits heated phase change ink of a single color from multiple printheads and detects leaked ink within the module. The printhead module includes a printhead having an inlet for receiving heated phase change ink from a source of ink. The printhead is mounted to a housing which includes a channel. A heated conduit is operatively connected to the inlet of the printhead and is operatively connected to the source of ink to carry heated phase change ink from the source of ink to the printhead, wherein a portion of the heated conduit is disposed in the housing. The printhead module includes a temperature sensing device configured to sense a change in temperature in response a leaked heated phase change ink contacting the temperature sensing device. The temperature sensing device is positioned at the channel where gravity can direct the leaked heated phase change ink into contact with the temperature sensing device.

BRIEF DESCRIPTION OF THE DRAWINGS

The foregoing aspects and other features of a printhead, a phase change ink reservoir and an ink jet imaging system are explained in the following description, taken in connection with the accompanying drawings.

DETAILED DESCRIPTION

Figure 1:
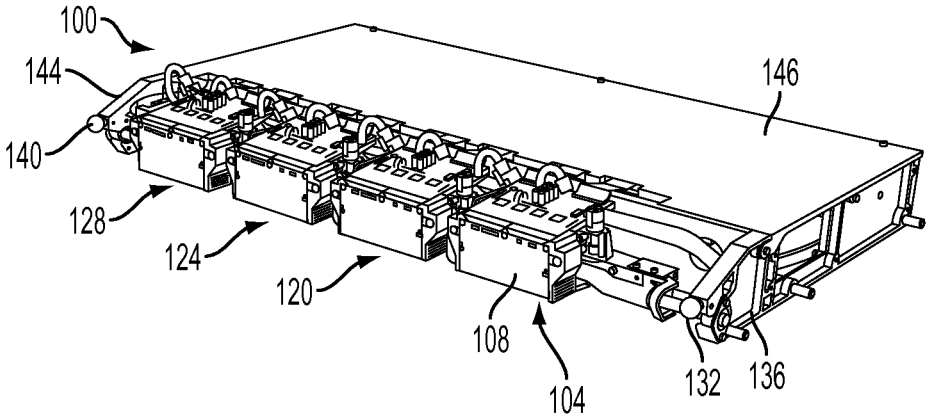
FIG. 1 PRIOR ART
FIG. 1 is a perspective view of a prior art printhead module including an array of printheads.

For a general understanding of the present embodiments, reference is made to the drawings. In the drawings, like reference numerals have been used throughout to designate like elements. As used herein, the terms "printer" generally refer to an apparatus that applies an ink image to print media and can encompass any apparatus, such as a digital copier, bookmaking machine, facsimile machine, multi-function machine, etc. which performs a printing function for any purpose.

As used herein, the term "inkjet printer" generally refers to a device that produces ink images on print media. "Print media" can be a physical sheet of paper, plastic, or other suitable physical print media substrate for images, whether precut or web fed. The imaging device can include a variety of other components, such as finishers, paper feeders, and the like, and can be embodied as a copier, printer, or a multifunction machine. A "print job" or "document" is normally a set of related sheets, usually one or more collated copy sets copied from a set of original print job sheets or electronic document page images, from a particular user, or otherwise related. An image generally includes information in electronic form which is to be rendered on the print media by the marking engine and can include text, graphics, pictures, and the like.

As used in this document, "ink" refers to a colorant that is liquid when applied to an image receiving member. For example, ink can be aqueous ink, ink emulsions, solvent based inks and phase change inks. "Phase changes ink" refers to inks that are in a solid or gelatinous state at room temperature and change to a liquid state when heated to an operating temperature for application or ejection onto the print media. The phase change inks return to a solid or gelatinous state when cooled on the print media after the printing process.

The term "printhead" as used herein refers to a component in the printer that is configured to eject ink drops onto the image receiving member. A typical printhead includes a plurality of inkjets that are configured to eject ink drops of one or more ink colors onto the print media. The inkjets are arranged in an array of one or more rows and columns. In some embodiments, the inkjets are arranged in staggered diagonal rows across a face of the printhead. Various printer embodiments include one or more printheads that form ink images on the print media.

FIG. 1 depicts a prior art printhead module 100. Printhead module 100 includes printhead units 104, 120, 124, and 128, docking balls 132 and 140, and printhead array carriage members 136 and 144. A top cover 146 provides a cover for the printhead module 100. Each printhead unit 104, 120, 124, and 128 includes a printhead face, with printhead unit 104 shown having a front faceplate 108. The printhead faceplate 108 includes an array of apertures to which inkjets are fluidly coupled for the ejection of ink drops onto the print media. A printer can include one or more printhead modules, such as printhead module 100 that are configured to eject ink having one or more colors for application onto the print media.

Figure 2:
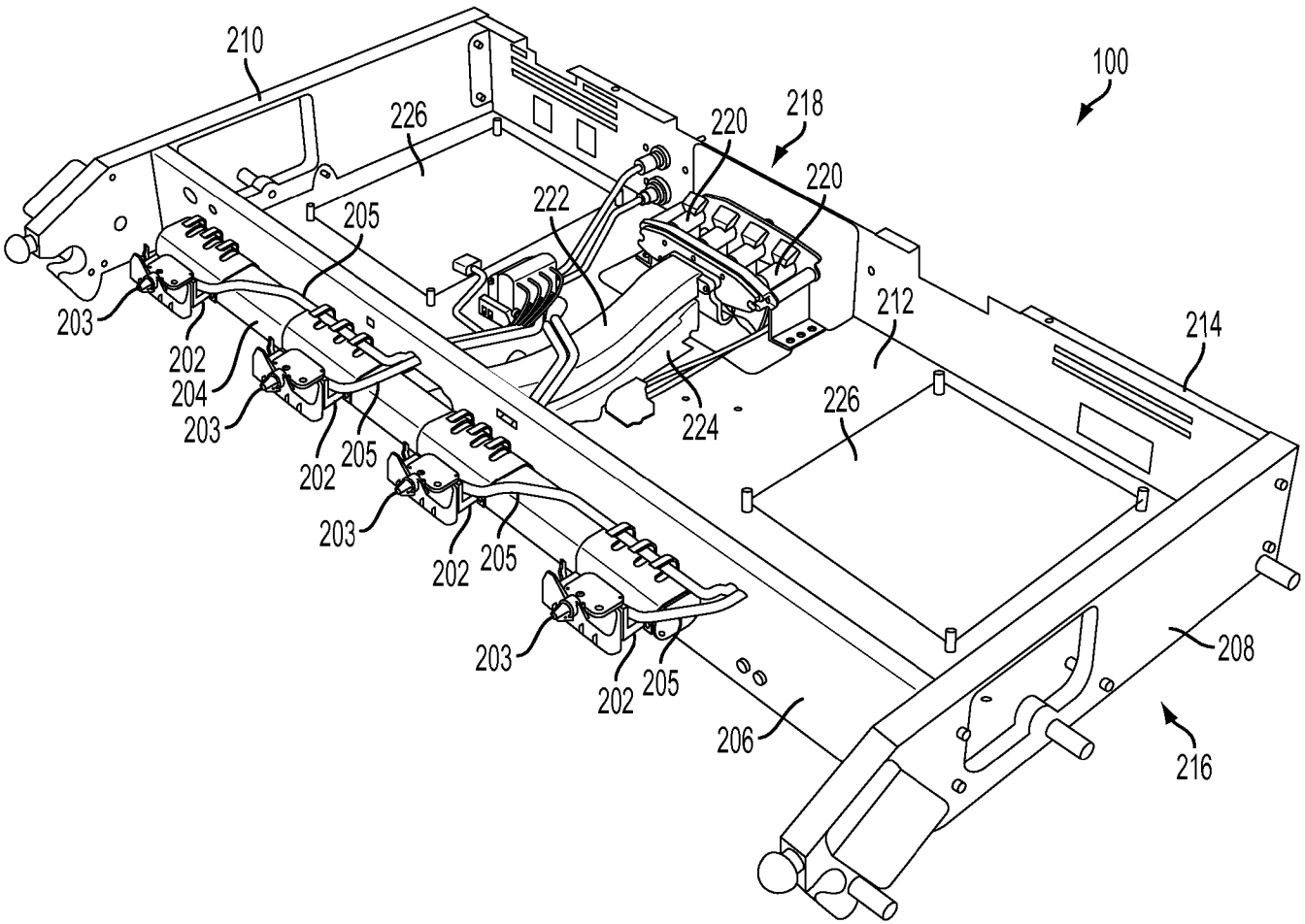
FIG. 2 is a perspective view of an interior of a printhead module without printheads.

FIG. 2 is a perspective view of the printhead module 100 of FIG. 1 without the top cover 146 and the printhead units 104, 120, 124, and 128. One or more printhead modules 100 can be incorporated into a printing apparatus where each of the individual printhead modules 100 can print a single color of heated phase change ink through the plurality of printheads.

Each one of a plurality of printhead supports 202 supports a printhead unit (see FIG. 1) where the plurality of printhead supports 202 are supported by a support bar 204 coupled to a front wall 206 of the printhead module 100. Each of the printhead supports 202 includes an electrical connector 203, which provides electrical control and printing signals to the printhead that are received from electrical cables 205.

The front wall 206 cooperates with a first side wall 208, a second side wall 210, a bottom wall 212, and a back wall 214 for form a housing 216, which supports the support bar 204. The housing 216 supports a manifold 218, which receives heated phase change ink from an ink reservoir of heated ink (not shown). The manifold 218 includes a plurality of ink injectors 220, which receive ink from the heated ink reservoir, each of which supply ink to one of the printheads, through a conduit cable 222. The conduit cable 222 includes a plurality of conduits, such as tubes or hoses, which can be heated and which carry the heated ink to respective printheads. A conduit support 224, disposed between the conduit cable 222 and the bottom wall 212, provides support to the conduit cable 222 and the individual conduits disposed therein. The support 224, not only provides support for the cables, but can support a plurality of ink leakage detectors as described herein. The support 224 is shown being configured to provide support for a change in height from the exit point of the conduits at the manifold 218 to locations where the conduits enter the printheads. Other sizes and shapes of the support 224 can also be provided for different configurations of conduits cables and conduits. One or more printed circuit boards 226 are disposed on either side of the cable 222. The printed circuit boards 226 provide a variety of control functions for the printheads carried by the cables 205. The printed circuit boards can also provide control signals to control the flow of the heated phase change ink delivered by the injectors 220.

Figure 3:
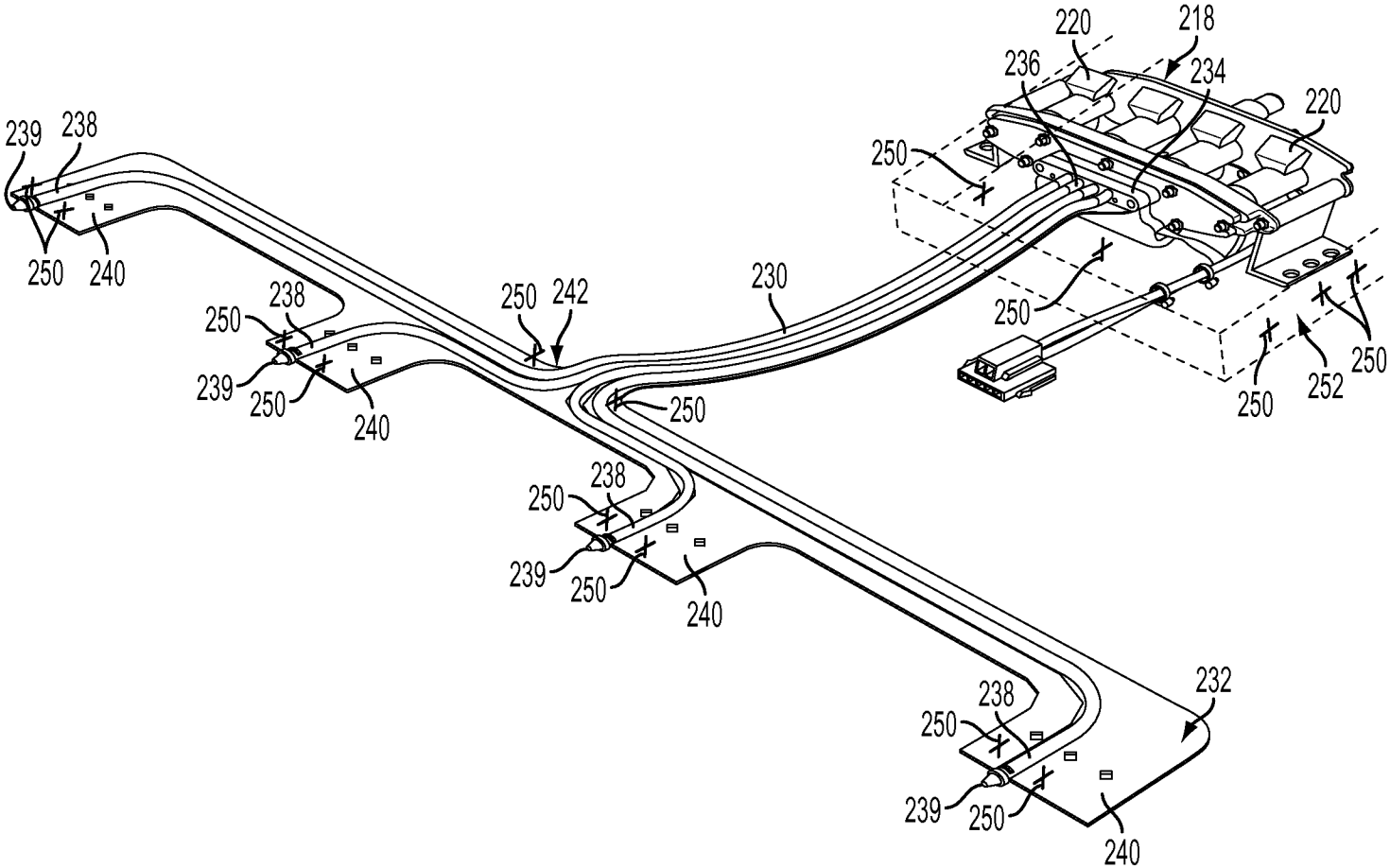
FIG. 3 is a perspective view a manifold coupled to a plurality of conduits supported by a leakage tray of a printhead module.

FIG. 3 is a perspective view of manifold 218 coupled to a plurality of conduits 230 and supported by a leakage support or tray 232 disposed beneath the conduits 230. While the leakage tray 232 is illustrated to subtend only a portion of the conduits, the leakage tray 232 can extend to the manifold 218 beneath the conduits 230. The tray 232 can be substantially planar but can also be formed to include non-planar structures such as the structure of support 224.

The conduits 230 are coupled to an output manifold 234 at a first end 236 and terminate at a plurality of second ends 238, each of which is coupled to one of the respective printheads of FIG. 1. At each of the second ends 238, a coupler 239 terminates the respective conduit at a preselected termination point for coupling of the conduit to the associated printhead. The leakage tray 232 includes a plurality of arms 240, each of which subtends a conduit 230, or portion thereof, and the conduit second end 238. Each of the arms 240 is coupled to central portion 242, which supports a portion of each of the conduits 230.

Ink leaks can occur at certain locations within the printhead module 100, such as at connection points between the conduits and the output manifold 234 and at the couplers 239 between the conduits 230 and the printheads. The heated phase change ink can collect along the length of the conduits, run down the conduits, and drip into the housing 216 at various locations, including whenever one or more of the printhead modules 100 are mounted at an angle as described later in FIG. 9. Also, over a period of time, various ink delivery connection components can fail, including cracked or split conduits, leaky O-ring seals and other sealing components, thereby providing additional sources of leaked ink. Consequently, if any of the liquid ink leaks out of the conduits or regulators or components, a repair may be required and downtime for the printer occurs. Because heated liquid phase change ink is electrically non-conductive and thermally hot, traditional sensor technologies have been found lacking.

To detect leaking hot ink, the printhead module 100 includes a plurality of leak detectors 250 placed at a plurality of locations. The leak detectors change their state in response to sensing a leaked ink. The leak detectors 250 can be located at predetermined locations within the housing 216 where leaked ink has been found to collect. The leak detectors 250 can also be located at other leak sources where leaked ink can potentially collect due to a printer and printhead module design. For instance, as illustrated in FIG. 3, a plurality of leak detectors 250 can be located along the arms 240 of the leakage tray 232. The leak detectors 250 can be specifically placed at or adjacent to the couplers 239. Additional leak detectors can be placed beneath and along each of the individual conduits 230. Other leak detectors can be placed within a manifold housing 252, here shown in dotted line. Leak detectors can also be strategically placed inside the housing 216 and along the front side of a printhead module, which can be pitched forward when mounted inside the printer of FIG. 9

In one embodiment, the leak detectors can include a plurality of resistance temperature detectors, also known as resistive thermal devices (RTDs). RTDs have a resistivity that changes linearly with temperature occurring within a specific temperature range. There are many different styles of RTDs. For one embodiment, a film type RTD can be used. Film RTDs have a layer of platinum on a substrate where the layer can be as thin as one micrometer. This thickness is useful for the detection of leaking the liquid wax based ink to cross over, cover, or come in contact with the sensor. RTDs can also be highly accurate and obtained at a relatively low cost. A standard RTD sheath is 3.175 to 6.35 mm thick. Thin glass coated and surface mount RTDs can also be used.

Figure 4:
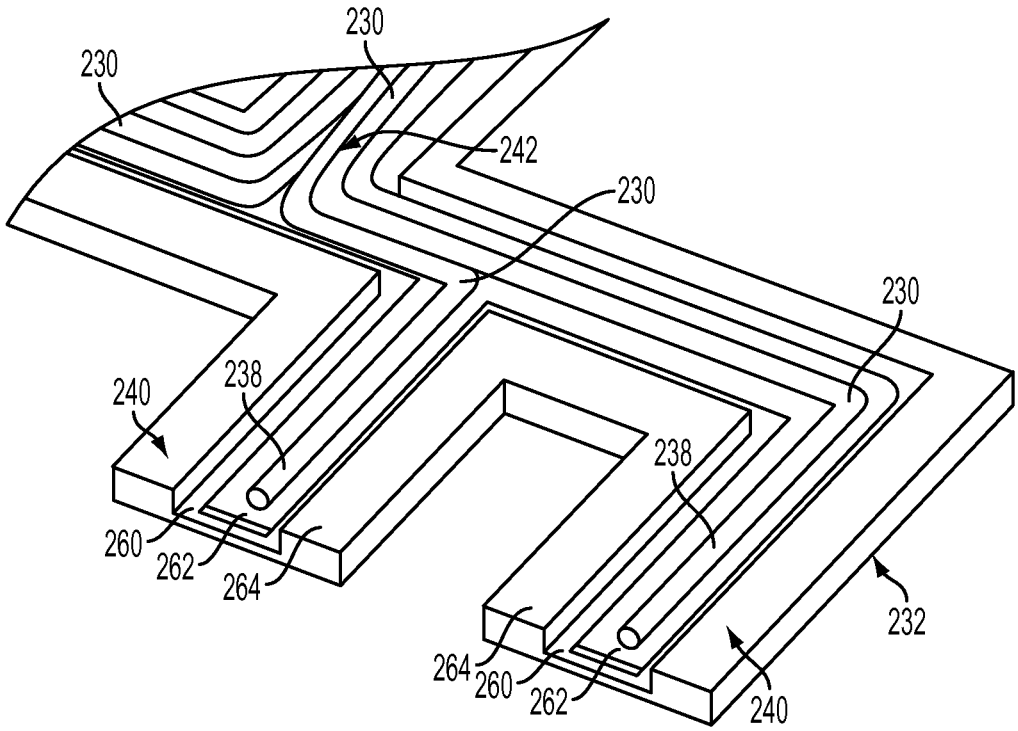
FIG. 4 is a simplified partial perspective view of portion of the leakage tray of FIG. 3.

FIG. 4 is a simplified partial perspective view of a portion of the leakage tray 232 of FIG. 3. Each of the arms 240, two of which are illustrated, can include a channel 260 to provide a recessed portion of the tray to collect leaked ink. The channel 260 of one arm can be connected to the channels of the other arms or can be formed to be unconnected with channels located at other arms 240 supporting individual conduits. In addition to providing a recess to collect ink, the channel 260 can also support individual RTDs coupled to a circuit or to an RTD member 262 that includes a plurality of RTD sensors arranged as a strip, which are held in a fixed position within an encapsulation, such as an emulsification. The encapsulated RTD strip 262 can be placed between a bottom surface of the channel and the conduit aligned with the channel. If so, the depth of the channel should be sufficient to provide a recess for leaked ink such that the top surface of the encapsulated RTD strip 262 is below and adjacent top surface 264 of the arm 240. The channel can also be made deeper to provide a collection area for leaking ink. The channel can also extend from the central portion 242 to the first ends 236 of the conduits should the tray 232 extend the length of the conduits.

While preassembled encapsulated RTD strips are manufactured by a number of manufacturers and available through a distributor such as Digi-Key Corporation of Thief River Falls, Minn., another embodiment can include a custom emulsified RTD strip that uses strategically placed RTDs in containment channel 260. The RTD strip could also be located at other preselected locations within the printhead module 100 including within the housing 252. The backside of the RTD strips can also include an adhesive, which can help maintain the location of the RTD strip when placed on the tray 232 or at other locations within the printhead module 100.

Figure 5:
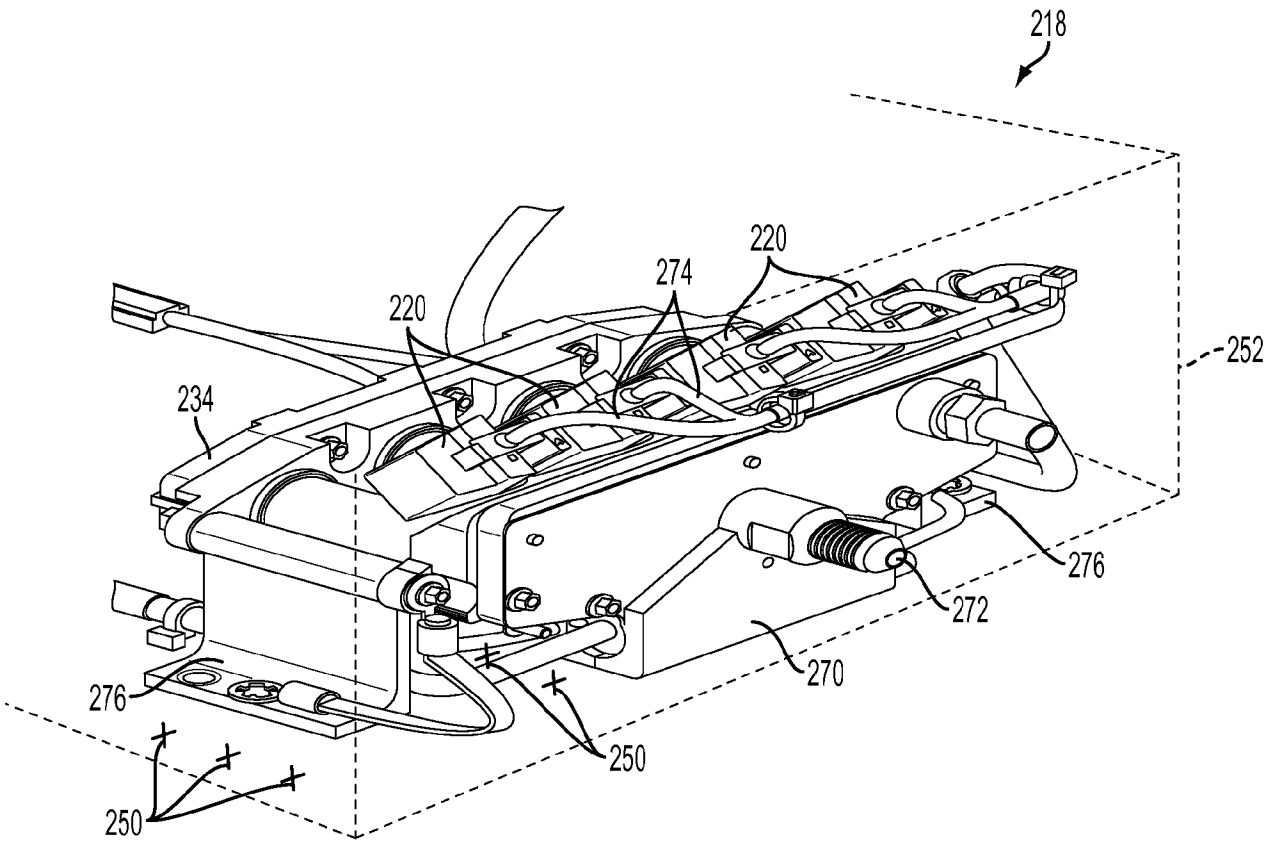
FIG. 5 is a perspective view of the manifold including a plurality of ink injectors and ink leakage detectors.

FIG. 5 is a rear perspective view of the manifold assembly 218 including a plurality of ink leakage detectors 250 located within the housing 252, shown in outline. The assembly 218 includes the output manifold 234, an input manifold 270 and the plurality of injectors 220 disposed therebetween. The input manifold 270 includes an ink inlet 272 including a fitting to couple to and to receive ink from an external reservoir of ink (not shown). The ink inlet 272 is coupled to a hose and a divider (not shown), which couples to a plurality of ink tubes 274 to provide ink to one of four injectors 220. The injectors are electronically controlled to provide a specified flow of ink to the conduits 238. Mounting brackets 276 are coupled to the bottom wall 212 and to at least one of the input manifold 270 and output manifold 234.

Because ink can leak from a number of areas of the manifold assembly 218, a plurality of leak detectors 250 can be placed within the housing 252. For instance, detectors 250 can be placed on the bottom wall 212 along the outside of one or both of the mounting brackets 250 either individually or as emulsified strips. Individual detectors can also be positioned at possible points of ink leakage, such as beneath the ink inlet 272, beneath the injectors 220, or beneath the input manifold and the output manifold 234. Because the housing 252 provides a substantially enclosed place, channels within a tray as described hereinbefore, need not be provided. In another embodiment, a tray with or without recesses or channels can be provided within the housing or the bottom wall can include preformed channels or recesses.

Figure 6:
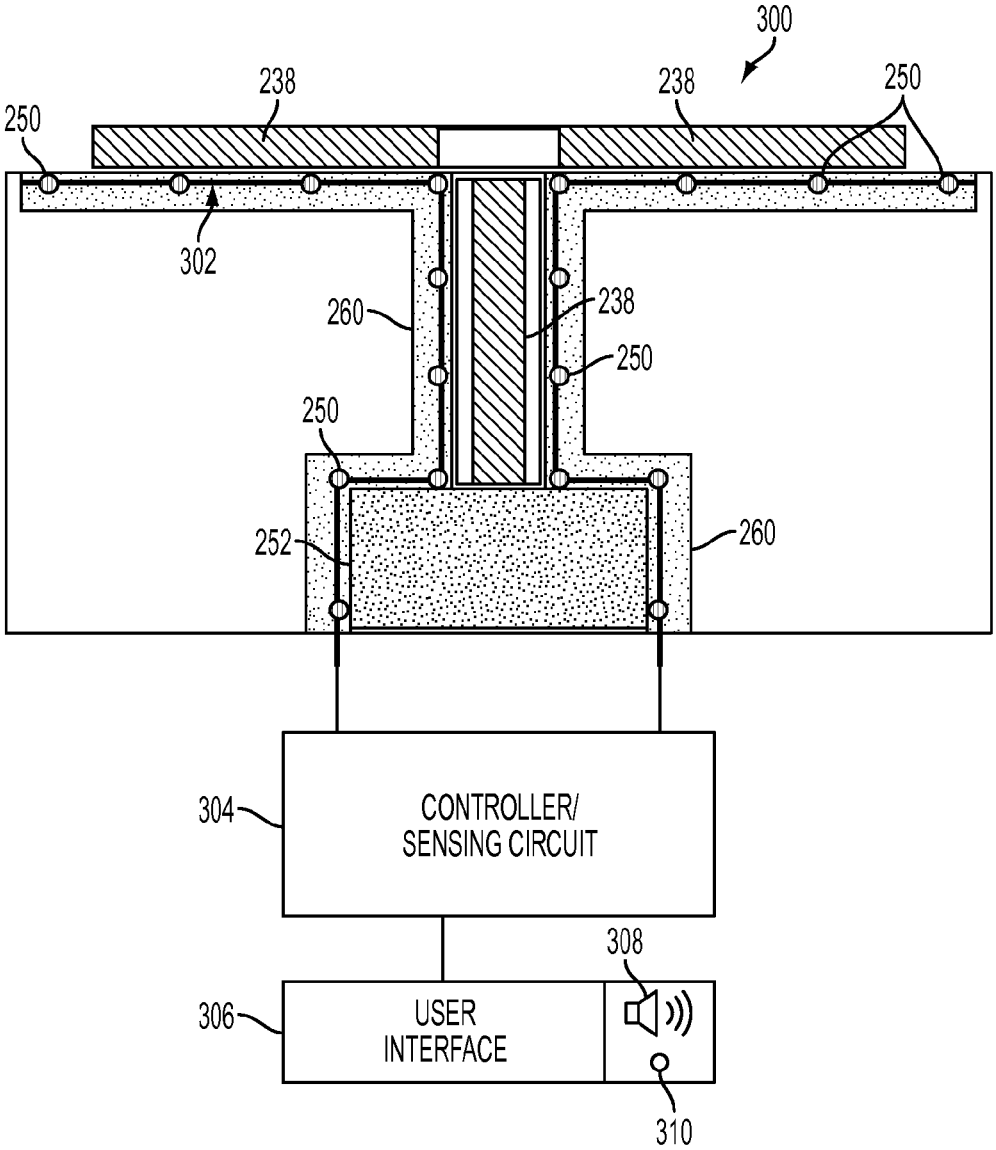
FIG. 6 is a block diagram of an electronic circuit to sense leaked ink.

FIG. 6 is a block diagram of a circuit 300 to sense ink that can leak into the printhead module 100. A plurality of the RTDs 250 disposed within one or more channels are coupled through a serial and/or parallel circuit 302. The plurality of RTDs 250 can be arranged as a linear array or multi-dimensional array, as individual RTDs or as the RTD strip 262 as described above. Circuit connection schemes between individual RTDs can vary based on a desired result. For instance, if an ink leak is detected by any one RTD and a single alarm is desired to indicate the existence of a leak detected at any one RTD, a serial connection can be used. In another embodiment, a parallel connection can be used to provide a detected leak at each specific location where a RTD 250 is positioned. Consequently, the specific location of a leak can be determined, not only within an RTD array, but can also be determined at other locations within the printhead module 100 where RTDs can be specifically located and wired accordingly.

The circuit 302 is coupled to a controller 304, which can provide power to the circuit 302 and which can also provide additional functions such as the location of a detected leak. The controller 304 can provide a signal acting as an annunciator to indicate the status of the RTDs. A processor having software programmed to interpret different programmed fault modes can be included in the controller. A non-volatile memory within the controller could provide the annunciator signal when a threshold is exceeded to activate an audible alarm, a visual alarm, or a physical/tactile alarm. Additionally, the annunciator can include a signal channel or a portion of a signal channel, either wired or wireless embodied in either hardware or software or both, through which a leak signal is communicated to a user. Upon detecting a leak, a user interface 306 coupled to the controller 304 receives a signal from the controller to provide the annunciator. The annunciator can include an audible alarm 308, a visual alarm 310, or both. The audible alarm 308 can include a speaker. The user interface 306 can include a light, such as a light emitting diode, as the visual alarm, or a graphical user interface can be provided and programmed to provide a desired visual alarm, such as a pop-up. The annunciator can also include transmission of the annunciator signal remotely to a cellphone, pager, or other electronic device. The alarm features can be implemented with hardware or with software control to distinguish between different states of the alarms. For instance, signals indicating temperatures, fault duration, or time between faults can be provided.

FIG. 6 also illustrates another embodiment, which includes the channel 260 being provided around a perimeter of the housing 252 of the manifold 218. The channel 260 around the housing 252 can be provided without the previously described detectors 250 located within the housing 250 or the channel can be provided in addition to the previously describe detectors 250 internal to the housing.

Figure 7:
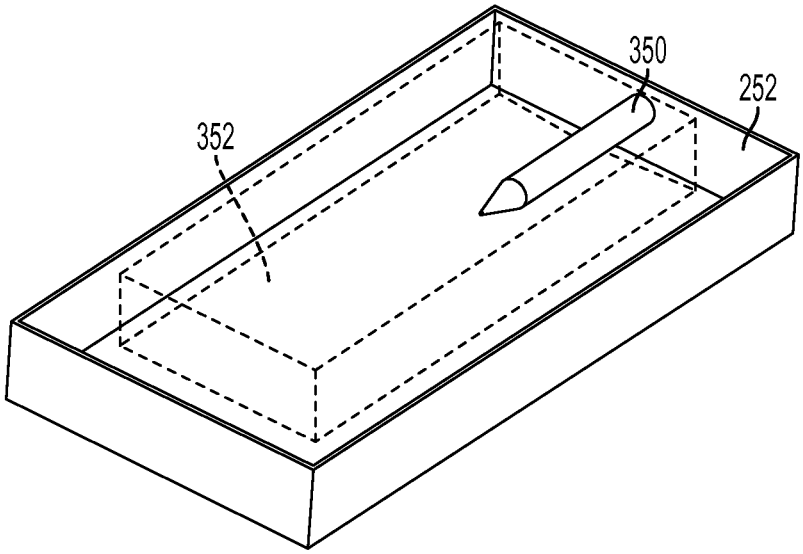
FIG. 7 is a schematic perspective view of thermistor within a housing to detect leaked ink.

FIG. 7 is a schematic perspective view of a thermistor 350 located within the housing 252 to detect leaked ink. As previously described, ink is delivered to the print heads and the flow of ink is metered by the injectors 220 mounted in between the input manifold 270 and output manifold 234. Ink leakage can occur within the housing area due to O-ring fit tolerances or separation of the input and output manifolds due to hardware failure. If ink leaks without being effectively monitored and controlled, the housing 252 and even the printhead module 100 can become filled with ink, thereby contaminating printed circuits, printed wire board assemblies and other devices, until the leaded ink eventually drips onto the print heads and the printhead modules located below. Printhead locating motors can bind up and dripping ink can fall onto the web, causing the web to break.

A collection tray 352, shown in outline, can be placed beneath and around the injectors 220 (not shown) inside the housing 252. The thermistor 350 can be mounted horizontally inside the tray 352. Other orientations are also within the scope of the present invention. The thermistor is then energized to a setpoint temperature that is higher than the temperature of the liquid phase change ink. The amount of power driving the thermistor is monitored by the controller 304. If a leak occurs and begins to fill the collection tray 352, the heated ink eventually contacts the tip of the thermistor 350. Upon contact with the ink, the heated thermistor 350 is quenched and its temperature drops rapidly. The controller 304 then increases the amount of power being applied to the thermistor in order to bring the thermistor temperature back up to the setpoint. This provides the change, or delta, in temperature to indicate a leak. When the change in power level crosses a pre-determined threshold, an output signal is generated to indicate the presence of a leak. The transmitted signal sounds the audible alarm 308 or illuminates the visual alarm 310. The software within the controller can also be programmed to provide a signal that an ink leak has occurred.

Figure 8:
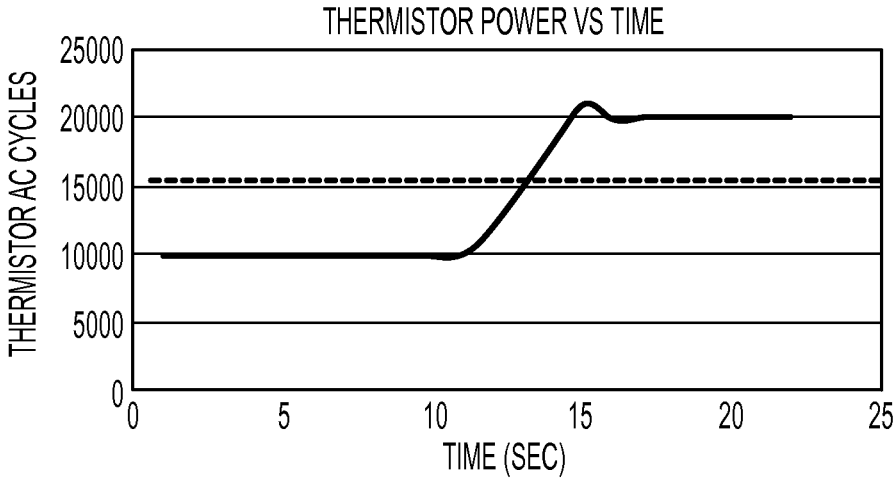
FIG. 8 is a graph of thermistor power versus time.

In one embodiment, when the ink temperature is maintained to 115° C., the controller 304 overdrives the thermistor 350 to a value, for example 25° C. above the ink temperature, or 140° C. The controller 304 provides an output of a plurality of AC clock cycles, for instance 10,000 cycles, to the thermistor 350 to maintain the temperature at 140° C. When ink fills the tray and touches the tip of the thermistor 350, the resistance state of the thermistor 350 rapidly increases. The controller 304 detects a rapid temperature drop as the thermistor is quenched in the cooler ink. The controller increases the AC power cycles to the thermistor in order to bring it back up to 140° C., for example 20,000 cycles. The threshold can be set at 15,000 clock cycles to trigger an output signal voltage to the machine software in order to signal an ink leak fault. The machine operator can then perform maintenance as needed. FIG. 8 is a graph of thermistor power versus time where thermistor power is correlated to the number of thermistor AC cycles.

Figure 9:
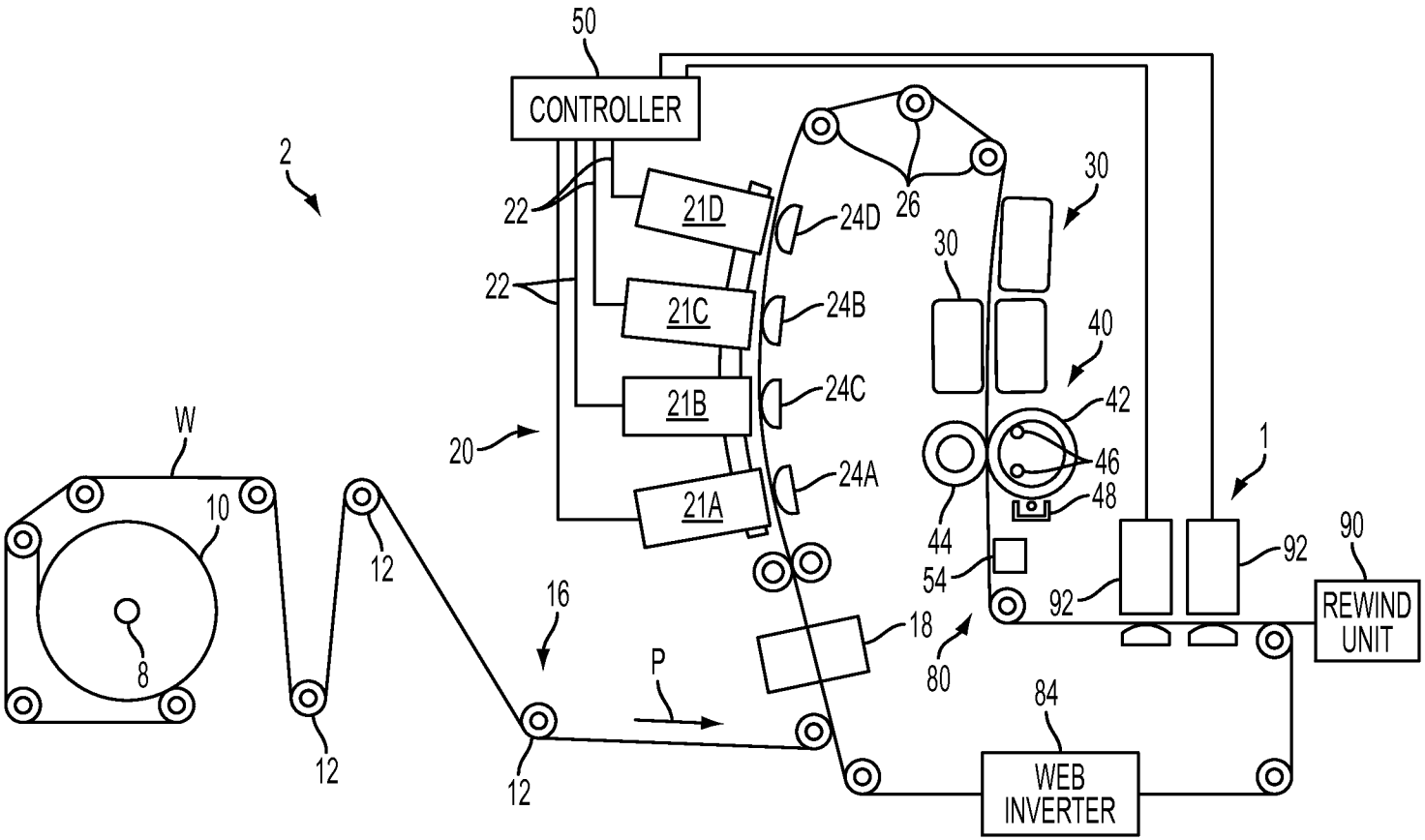
FIG. 9 PRIOR ART
FIG. 9 is a schematic view of a prior art inkjet imaging system that ejects ink onto a continuous web of media as the media moves past the printheads in the system.

FIG. 9 is a schematic view of a prior art inkjet printer that ejects ink onto a continuous web of media as the media moves past the printheads in the system. An embodiment of a printer, such as a high-speed phase change ink printer 2, in which the leak detector of the present disclosure can be used, is depicted. For the purposes of this disclosure, the inkjet printer of FIG. 9 employs one or more inkjet printheads and an associated solid ink supply. The imaging apparatus includes a print engine to process the image data before generating the control signals for the inkjet ejectors. The colorant can be ink, or any suitable substance that includes one or more dyes or pigments and that can be applied to the selected media. The colorant can be black, or any other desired color, and a given imaging apparatus can be capable of applying a plurality of distinct colorants to the media.

FIG. 9 is a simplified schematic view of a direct-to-sheet, continuous-media, phase-change inkjet imaging system 2, that can be modified to include the printhead module discussed above. A media supply and handling system is configured to supply a long (i.e., substantially continuous) web of media W of "substrate" (paper, plastic, or other printable material) from a media source, such as spool of media 10 mounted on a web roller 8. For simplex printing, the printer is comprised of feed roller 8, media conditioner 16, printing station 20, printed web conditioner 80, coating station 1, and rewind unit 90. For duplex operations, the web inverter 84 is used to flip the web over to present a second side of the media to the printing station 20, printed web conditioner 80, and coating station 1 before being taken up by the rewind unit 90. In the simplex operation, the media source 10 has a width that substantially covers the width of the rollers over which the media travels through the printer. In duplex operation, the media source is approximately one-half of the roller widths as the web travels over one-half of the rollers in the printing station 20, printed web conditioner 80, and coating station 1 before being flipped by the inverter 84 and laterally displaced by a distance that enables the web to travel over the other half of the rollers opposite the printing station 20, printed web conditioner 80, and coating station 1 for the printing, conditioning, and coating, if necessary, of the reverse side of the web. The rewind unit 90 is configured to wind the web onto a roller for removal from the printer and subsequent processing.

The media can be unwound from the source 10 as needed and propelled by a variety of motors, not shown, rotating one or more rollers. The media conditioner includes rollers 12 and a pre-heater 18. The rollers 12 control the tension of the unwinding media as the media moves along a path through the printer. In alternative embodiments, the media can be transported along the path in cut sheet form in which case the media supply and handling system can include any suitable device or structure that enables the transport of cut media sheets along a desired path through the imaging device. The pre-heater 18 brings the web to an initial predetermined temperature that is selected for desired image characteristics corresponding to the type of media being printed as well as the type, colors, and number of inks being used. The preheater 18 can use contact, radiant, conductive, or convective heat to bring the media to a target preheat temperature, which in one practical embodiment, is in a range of about 30° C. to about 70° C.

The media is transported through a printing station 20 that includes a series of printhead modules, which are sometimes known as print box units, 21A, 21B, 21C, and 21D, each printhead module effectively extending across the width of the media and being able to place ink directly (i.e., without use of an intermediate or offset member) onto the moving media. Any one, some, or all of the printhead modules 21A-21D can be angled with respect to horizontal. If so, leaked ink tends to flow in a certain direction under the influence of gravity. The printhead modules 21A, 21B, 21C and 21D correspond to the printhead module 100 described above. As is generally familiar, each of the printheads of the printhead array can eject a single color of ink, one for each of the colors typically used in color printing, namely, cyan, magenta, yellow, and black (CMYK).

The controller 50 of the printer receives velocity data from encoders mounted proximately to rollers positioned on either side of the portion of the path opposite the four printheads to compute the position of the web as moves past the printheads. The controller 50 uses these data to generate timing signals for actuating the inkjet ejectors in the printheads to enable the four colors to be ejected with a reliable degree of accuracy for registration of the different color patterns to form four primary-color images on the media. The inkjet ejectors actuated by the firing signals corresponds to image data processed by the controller 50. The image data can be transmitted to the printer, generated by a scanner (not shown) that is a component of the printer, or otherwise generated and delivered to the printer. In various possible embodiments, a printhead module for each primary color can include one or more printheads; multiple printheads in a module can be formed into a single row or multiple row array; printheads of a multiple row array can be staggered; a printhead can print more than one color; or the printheads or portions thereof can be mounted movably in a direction transverse to the process direction P, such as for spot-color applications and the like.

The printer 2 uses "phase-change ink" as that term has been previously defined above. Associated with each printhead module is a backing member 24A-24D, typically in the form of a bar or roll, which is arranged substantially opposite the printhead on the back side of the media. Each backing member is used to position the media at a predetermined distance from the printhead opposite the backing member. Each backing member can be configured to emit thermal energy to heat the media to a predetermined temperature which, in one practical embodiment, is in a range of about 40° C. to about 60° C. The various backer members can be controlled individually or collectively. The pre-heater 18, the printheads, backing members 24 (if heated), as well as the surrounding air combine to maintain the media along the portion of the path opposite the printing station 20 in a predetermined temperature range of about 40° C. to 70° C.

As the partially-imaged media moves to receive inks of various colors from the printheads of the printing station 20, the temperature of the media is maintained within a given range. Ink is ejected from the printheads at a temperature typically significantly higher than the receiving media temperature. Consequently, the ink heats the media. Therefore other temperature regulating devices can be employed to maintain the media temperature within a predetermined range. For example, the air temperature and air flow rate behind and in front of the media can also impact the media temperature. Accordingly, air blowers or fans can be utilized to facilitate control of the media temperature. Thus, the media temperature is kept substantially uniform for the jetting of all inks from the printheads of the printing station 20. Temperature sensors (not shown) can be positioned along this portion of the media path to enable regulation of the media temperature. Temperature data can also be used by systems for measuring or inferring (from the image data, for example) how much ink of a given primary color from a printhead is being applied to the media at a given time.

Following the printing zone 20 along the media path are one or more "mid-heaters" 30. A mid-heater 30 can use contact, radiant, conductive, and/or convective heat to control a temperature of the media. The mid-heater 30 brings the ink placed on the media to a temperature suitable for desired properties when the ink on the media is sent through the spreader 40. In one embodiment, a useful range for a target temperature for the mid-heater is about 35° C. to about 80° C. The mid-heater 30 has the effect of equalizing the ink and substrate temperatures to within about 15° C. of each other. Lower ink temperature gives less line spread while higher ink temperature causes show-through (visibility of the image from the other side of the print). The mid-heater 30 adjusts substrate and ink temperatures to 0° C. to 20° C. above the temperature of the spreader.

Following the mid-heaters 30, a fixing assembly 40 is configured to apply heat and/or pressure to the media to fix the images to the media. The fixing assembly can include any suitable device or apparatus for fixing images to the media including heated or unheated pressure rollers, radiant heaters, heat lamps, and the like. In the embodiment of the FIG. 9, the fixing assembly includes a "spreader" 40, that applies a predetermined pressure, and in some implementations, heat, to the media. The function of the spreader 40 is to take what are essentially droplets, strings of droplets, or lines of ink on web W and smear them out by pressure and, in some systems, heat, so that spaces between adjacent drops are filled and image solids become uniform. In addition to spreading the ink, the spreader 40 can also improve image permanence by increasing ink layer cohesion and/or increasing the ink-web adhesion. The spreader 40 includes rollers, such as image-side roller 42 and pressure roller 44, to apply heat and pressure to the media. Either roll can include heat elements, such as heating elements 46, to bring the web W to a temperature in a range from about 35° C. to about 80° C. In alternative embodiments, the fixing assembly can be configured to spread the ink using non-contact heating (without pressure) of the media after the print zone. Such a non-contact fixing assembly can use any suitable type of heater to heat the media to a desired temperature, such as a radiant heater, UV heating lamps, and the like.

In one embodiment, the roller temperature in spreader 40 is maintained at a temperature to an optimum temperature that depends on the properties of the ink such as 55° C.; generally, a lower roller temperature gives less line spread while a higher temperature causes imperfections in the gloss. Roller temperatures that are too high can cause ink to offset to the roll. In one practical embodiment, the nip pressure is set in a range of about 500 to about 2000 psi lbs./side. Lower nip pressure gives less line spread while higher pressure can reduce pressure roller life.

The spreader 40 can also include a cleaning/oiling station 48 associated with image-side roller 42. The station 48 cleans and/or applies a layer of some release agent or other material to the roller surface. The release agent material can be an amino silicone oil having viscosity of about 10-200 centipoises. Only small amounts of oil are required and the oil carried by the media is only about 1-10 mg per A4 size page. In one possible embodiment, the mid-heater 30 and spreader 40 can be combined into a single unit, with their respective functions occurring relative to the same portion of media simultaneously. In another embodiment the media is maintained at a high temperature as it is printed to enable spreading of the ink.

The coating station 1 applies a clear ink to the printed media. This clear ink helps protect the printed media from smearing or other environmental degradation following removal from the printer. The overlay of clear ink acts as a sacrificial layer of ink that can be smeared and/or offset during handling without affecting the appearance of the image underneath. The coating station 1 can apply the clear ink with either a roller or a printhead 92 ejecting the clear ink in a pattern. Clear ink for the purposes of this disclosure is functionally defined as a substantially clear overcoat ink that has minimal impact on the final printed color, regardless of whether or not the ink is devoid of all colorant. In one embodiment, the clear ink utilized for the coating ink comprises a phase change ink formulation without colorant. Alternatively, the clear ink coating can be formed using a reduced set of typical solid ink components or a single solid ink component, such as polyethylene wax, or polywax. As used herein, polywax refers to a family of relatively low molecular weight straight chain poly ethylene or poly methylene waxes. Similar to the colored phase change inks, clear phase change ink is substantially solid at room temperature and substantially liquid or melted when initially jetted onto the media. The clear phase change ink can be heated to about 100° C. to 140° C. to melt the solid ink for jetting onto the media.

Following passage through the spreader 40 the printed media can be wound onto a roller for removal from the system (simplex printing) or directed to the web inverter 84 for inversion and displacement to another section of the rollers for a second pass by the printheads, mid-heaters, spreader, and coating station. The duplex printed material can then be wound onto a roller for removal from the system by rewind unit 90. Alternatively, the media can be directed to other processing stations that perform tasks such as cutting, binding, collating, and/or stapling the media or the like.

Operation and control of the various subsystems, components and functions of the device 2 are performed with the aid of the controller 50. The controller 50 can be implemented with general or specialized programmable processors that execute programmed instructions. The instructions and data required to perform the programmed functions can be stored in memory associated with the processors or controllers. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits.

The imaging system 2 can also include an optical imaging system 54 that is configured in a manner similar to that described above for the imaging of the printed web. The optical imaging system is configured to detect, for example, the presence, intensity, and/or location of ink drops jetted onto the receiving member by the inkjets of the printhead assembly. The light source for the imaging system can be a single light emitting diode (LED) that is coupled to a light pipe that conveys light generated by the LED to one or more openings in the light pipe that direct light towards the image substrate. In one embodiment, three LEDs, one that generates green light, one that generates red light, and one that generates blue light are selectively activated so only one light shines at a time to direct light through the light pipe and be directed towards the image substrate. In another embodiment, the light source is a plurality of LEDs arranged in a linear array. The LEDs in this embodiment direct light towards the image substrate. The light source in this embodiment can include three linear arrays, one for each of the colors red, green, and blue. Alternatively, all of the LEDS can be arranged in a single linear array in a repeating sequence of the three colors. The LEDs of the light source can be coupled to the controller 50 or some other control circuitry to activate the LEDs for image illumination.

The reflected light is measured by the light detector in optical sensor 54. The light sensor, in one embodiment, is a linear array of photosensitive devices, such as charge coupled devices (CCDs). The photosensitive devices generate an electrical signal corresponding to the intensity or amount of light received by the photosensitive devices. The linear array that extends substantially across the width of the image receiving member. Alternatively, a shorter linear array can be configured to translate across the image substrate. For example, the linear array can be mounted to a movable carriage that translates across image receiving member. Other devices for moving the light sensor can also be used.

It will be appreciated that several of the above-disclosed and other features, and functions, or alternatives thereof, can be desirably combined into many other different systems or applications. Various presently unforeseen or unanticipated alternatives, modifications, variations, or improvements therein can be subsequently made by those skilled in the art, which are also intended to be encompassed by the following claims.

What is claimed is:

1. A printing apparatus to deposit heated phase change ink on recording media comprising:

a printhead having an inlet for receiving heated phase change ink from a source of ink;

a heated conduit having a first end and a second end, the first end of the heated conduit being operatively connected to the inlet of the printhead and the second end being operatively connected to the source of ink to carry heated phase change ink from the source of ink to the printhead;

a planar member that underlies at least a portion of the heated conduit the planar member extending away from the printhead and the inlet of the printhead and being located between the first end of the heated conduit operatively connected to the inlet of the printhead and the second end operatively connected to the source of ink;

a temperature sensing device positioned on the planar member between the first end of the heated conduit and the second end of the heated conduit, the temperature sensing device being configured to generate an electrical signal indicative of heated phase change ink contacting the temperature sensing device outside the printhead, the temperature sensing device being positioned on the planar member at a location where gravity directs heated phase change ink that has leaked from the heated conduit into contact with the temperature sensing device; and an annunciator operatively connected to the temperature sensing device to receive the electrical signal generated by the temperature sensing device, the annunciator being configured to generate a signal indicative that heated phase change ink external to the heated conduit and printhead is contacting the temperature sensing device.

2. The printing apparatus of claim 1 further comprising:

a controller operatively connected to the temperature sensing device and the annunciator, the controller being configured to monitor the electrical signal generated by the temperature sensing device and to activate the annunciator to generate the signal indicative that heated phase change ink external to the heated conduit and printhead is contacting the temperature sensing device.

3. The printing apparatus of claim 2, the planar member further comprising:

a channel having a first end and a second end, a portion of the channel between the first end and the second end underlying the portion of the heated conduit to enable the heated phase change ink leaking from the heated conduit to flow into the channel; and a plurality of temperature sensing devices positioned within the channel to detect heated phase change ink within the channel.

4. The printing apparatus of claim 3 wherein each temperature sensing device is operatively connected to the controller in parallel to enable the controller to monitor each temperature sensing device independently of the other temperature sensing devices.

5. The printing apparatus of claim 4 wherein the plurality of temperature sensing device are within a resistive thermal device (RTD) member having a first end and a second end, a portion of the RTD member between the first end and the second end being positioned within the channel to detect heated phase change ink contacting the RTD member.

6. The printing apparatus of claim 5 wherein the RTD member is operatively connected to the controller in parallel to enable the controller to monitor one of the plurality of temperature sensing devices independently of another of the plurality of temperature sensing devices.

7. The printing apparatus of claim 1 wherein the temperature sensing device includes a thermistor.

8. The printing apparatus of claim 7 wherein the thermistor is horizontally oriented on the planar member with reference to the heated conduit.

9. The printing apparatus of claim 8 wherein the controller is configured to operate the thermistor in an overdriven mode.

10. The printing apparatus of claim 1 wherein the temperature sensing device includes a resistive temperature device.

11. A printhead module configured to deposit heated phase change on a recording media comprising:

a printhead having an inlet for receiving heated phase change ink from a source of ink;

a housing to which the printhead is mounted, the housing including a planar member in which a channel is formed, the planar member and the channel in the planar member extending away from the printhead and the inlet of the printhead;

a heated conduit being operatively connected to the inlet of the printhead and the heated conduit being operatively connected to the source of ink to carry heated phase change ink from the source of ink to the printhead, a portion of the heated conduit being disposed in the housing above the planar member;

a temperature sensing device positioned outside of the printhead in the channel of the planar member to enable gravity to direct heated phase change ink leaking from the printhead or the heated conduit to the temperature sensing device, the temperature sensing device being configured to generate an electrical signal indicative of heated phase change ink contacting the temperature sensing device; and an annunciator operatively connected to the temperature sensing device to receive the electrical signal generated by the temperature sensing device, the annunciator being configured to generate a signal indicative that heated phase change ink external to the heated conduit and printhead is contacting the temperature sensing device.

12. The printhead module of claim 11 wherein the planar member is selectively separable from the housing.

13. The printhead module of claim 12, the temperature sensing device further comprising:

a resistive thermal device (RTD) member having a plurality of RTD sensors.

14. The printhead module of claim 13 wherein the RTD member is located in the channel.

15. The printhead module of claim 11 further comprising:

a plurality of heated conduits; and a manifold having a single input and a plurality of outputs, the manifold configured to receive heated phase change ink at the single input and to dispense the heated phase change ink at each of the plurality of outputs, each one of the plurality of heated conduits is coupled to the plurality of outputs in a one-to-one correspondence.

16. The printhead module of claim 15 further comprising:

a plurality of temperature sensing devices, at least one of the temperature sensing devices being positioned to enable gravity to direct heated phase change ink leaking from the manifold to the at least one temperature sensing device.

* * * * *